US011835890B2

(12) United States Patent
Matsumoto et al.

(10) Patent No.: US 11,835,890 B2
(45) Date of Patent: Dec. 5, 2023

(54) IMAGE FORMING APPARATUS

(71) Applicant: CANON KABUSHIKI KAISHA, Tokyo (JP)

(72) Inventors: Norihiro Matsumoto, Tokyo (JP); Fuyuko Koyama, Kanagawa (JP); Yasuhiro Fukase, Kanagawa (JP); Takeo Kawanami, Kanagawa (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 17/839,915

(22) Filed: Jun. 14, 2022

(65) Prior Publication Data

US 2022/0404742 A1 Dec. 22, 2022

(30) Foreign Application Priority Data

Jun. 17, 2021 (JP) ..... 2021-101096

(51) Int. Cl.
*G03G 15/16* (2006.01)
*G03G 15/01* (2006.01)

(52) U.S. Cl.
CPC ..... *G03G 15/162* (2013.01); *G03G 15/0131* (2013.01); *G03G 15/1615* (2013.01)

(58) Field of Classification Search
CPC ..... G03G 15/0131; G03G 15/0136; G03G 15/1605; G03G 15/1615; G03G 15/162;
(Continued)

(56) References Cited

U.S. PATENT DOCUMENTS

2007/0048005 A1* 3/2007 Nakano ..... G03G 21/1647 399/110
2015/0309447 A1 10/2015 Suzuki et al.
(Continued)

FOREIGN PATENT DOCUMENTS

EP 1008917 A2 6/2000
JP 2007057952 A 3/2007
(Continued)

OTHER PUBLICATIONS

Extended European Search Report issued in European Appln. No. 22179122.1 dated Nov. 21, 2022.

*Primary Examiner* — Carla J Therrien
(74) *Attorney, Agent, or Firm* — ROSSI, KIMMS & McDOWELL LLP

(57) ABSTRACT

An image forming apparatus includes a plurality of image bearing members, a transfer unit including an intermediate transfer belt, a plurality of transferring members which sandwich the intermediate transfer belt between the plurality of image bearing members and themselves, a biasing member which biases each of the plurality of transferring members toward the plurality of image bearing members via the intermediate transfer belt, and a frame which supports the intermediate transfer belt, the plurality of transferring members, and the biasing member, and an apparatus main body which supports the plurality of image bearing members and the transfer unit. The apparatus main body includes a supporting portion which supports the transfer unit and a biasing force receiving portion of which a position is between the plurality of transferring members in a moving direction of the surface of the intermediate transfer belt and which is capable of supporting the transfer unit.

12 Claims, 12 Drawing Sheets

(58) Field of Classification Search
CPC ..... G03G 21/1633; G03G 21/168; G03G 2221/1684
See application file for complete search history.

(56) References Cited

U.S. PATENT DOCUMENTS

| | | | | |
|---|---|---|---|---|
| 2016/0216650 | A1* | 7/2016 | Hatano | G03G 15/1615 |
| 2018/0120765 | A1 | 5/2018 | Seto | |
| 2018/0136603 | A1* | 5/2018 | Watanabe | G03G 21/1623 |
| 2019/0025726 | A1 | 1/2019 | Hatano | |
| 2019/0041774 | A1* | 2/2019 | Nakajima | G03G 15/0189 |
| 2020/0201208 | A1* | 6/2020 | Kouzu | G03G 15/161 |

FOREIGN PATENT DOCUMENTS

| | | | |
|---|---|---|---|
| JP | 2008040397 | A | 2/2008 |
| JP | 2012027506 | A | 2/2012 |

* cited by examiner

IMAGE FORMING APPARATUS

BACKGROUND OF THE INVENTION

Field of the Invention

The present invention relates to an image forming apparatus using an electrophotographic system such as a copier and a printer.

Description of the Related Art

As an image forming apparatus adopting an electrophotographic system, a tandem-type image forming apparatus is known in which a plurality of image forming portions are respectively arranged in a moving direction of a conveyance belt, an intermediate transfer belt, and the like. The image forming portion of each color has a drum-like photosensitive member (hereinafter, referred to as a photosensitive drum) as an image bearing member. A toner image of each color borne by the photosensitive drum of each color is transferred to a transfer material such as a sheet of paper or an OHP sheet to be conveyed by a transfer material conveyance belt or transferred to the transfer material after being temporarily transferred to the intermediate transfer belt and subsequently fixed to the transfer material by fixing unit.

In a configuration including the belt, a tensioning mechanism which imparts tension to a belt for stable driving and a pressing mechanism which biases the photosensitive drums from inside the belt for toner image transfer are provided. Since there is a risk that such a mechanism which applies a biasing force to a belt unit (hereinafter, referred to as a transfer unit) may cause creep deformation of a component to occur during transport, during long-term storage at a user's location, and the like, configurations offering countermeasures against occurrences of creep deformation have been provided.

For example, Japanese Patent Application Laid-open No. 2012-27506 discloses a configuration which suppresses creep deformation of a member by enabling tension imparted to a belt to be released. More specifically, a separation member provided inside the transfer unit is inserted with respect to a bearing which supports a roller (tension roller) which imparts tension to the belt. In such a configuration, the tension roller is held at a position where the tension on the belt is reduced against the biasing force of a spring which imparts the tension to the belt.

SUMMARY OF THE INVENTION

However, with a configuration which is provided with a mechanism for releasing belt tension as in the case of Japanese Patent Application Laid-open No. 2012-27506, at least a separation member must be newly provided. Therefore, an increase in cost that accompanies an increase in the number of components is a concern and there is also a risk that a separating operation may end up being ineffective due to an inability to perform the separating operation in accordance with a timing of creep deformation such as during convey, during long-term storage, or the like.

In consideration thereof, an object of the present invention is to provide an image forming apparatus which suppresses creep deformation in a stable manner with a simple configuration in accordance with a timing of creep deformation without newly providing a mechanism for releasing belt tension.

In order to achieve the object described above, an image forming apparatus according to the present invention includes:

- a plurality of image bearing members;
- a transfer unit;
- the transfer unit including:
  - an intermediate transfer belt;
  - a plurality of transferring members which sandwich the intermediate transfer belt between the plurality of image bearing members and the plurality of transferring members;
  - a biasing member which biases each of the plurality of transferring members toward the plurality of image bearing members via the intermediate transfer belt; and
  - a frame which supports the intermediate transfer belt, the plurality of transferring members, and the biasing member; and
- an apparatus main body which supports the plurality of image bearing members and the transfer unit;
- wherein the apparatus main body includes: a supporting portion which supports the transfer unit; and a biasing force receiving portion of which a position is between the plurality of transferring members in a moving direction of the surface of the intermediate transfer belt and which is capable of supporting the transfer unit.

In order to achieve the object described above, an image forming apparatus according to the present invention includes:

- a plurality of image bearing members;
- a transfer unit;
- the transfer unit including:
  - an intermediate transfer belt;
  - a plurality of transferring members which sandwich the intermediate transfer belt between the plurality of image bearing members and the plurality of transferring members;
  - a biasing member which biases each of the plurality of transferring members toward the plurality of image bearing members via the intermediate transfer belt; and
- a frame which supports the intermediate transfer belt, the plurality of transferring members, and the biasing member; and
- an apparatus main body which supports the plurality of image bearing members and the transfer unit;
- wherein the apparatus main body includes: a supporting portion which supports the transfer unit; and a biasing force receiving portion of which a position is below the plurality of transferring members in a direction orthogonal to a moving direction of the surface of the intermediate transfer belt and which is capable of supporting the transfer unit.

In order to achieve the object described above, an image forming apparatus according to the present invention includes:

- a plurality of image bearing members;
- a transfer unit;
- the transfer unit including:
  - an intermediate transfer belt;
  - a plurality of transferring members which sandwich the intermediate transfer belt between the plurality of image bearing members and the plurality of transferring members;

a biasing member which biases each of the plurality of transferring members toward the plurality of image bearing members via the intermediate transfer belt; and a frame which supports the intermediate transfer belt, the plurality of transferring members, and the biasing member; and an apparatus main body which supports the plurality of image bearing members and the transfer unit;

wherein the apparatus main body includes:

a first supporting portion which supports a side of one end of the transfer unit with respect to the intermediate transfer belt;

a second supporting portion which supports a side of other end of the transfer unit with respect to the intermediate transfer belt; and a biasing force receiving portion which is capable of supporting the transfer unit between the first supporting portion and the second supporting portion.

According to the present invention, by having a transfer unit being supported by a biasing force receiving portion provided on an apparatus main body of an image forming apparatus, creep deformation of a transferring member can be suppressed in a stable manner.

Further features of the present invention will become apparent from the following description of exemplary embodiments with reference to the attached drawings.

DESCRIPTION OF THE EMBODIMENTS

Hereinafter, a description will be given, with reference to the drawings, of embodiments (examples) of the present invention. However, the sizes, materials, shapes, their relative arrangements, or the like of constituents described in the embodiments may be appropriately changed according to the configurations, various conditions, or the like of apparatuses to which the invention is applied. Therefore, the sizes, materials, shapes, their relative arrangements, or the like of the constituents described in the embodiments do not intend to limit the scope of the invention to the following embodiments unless otherwise stated.

First Embodiment

Configuration of Image Forming Apparatus

Figure 1:
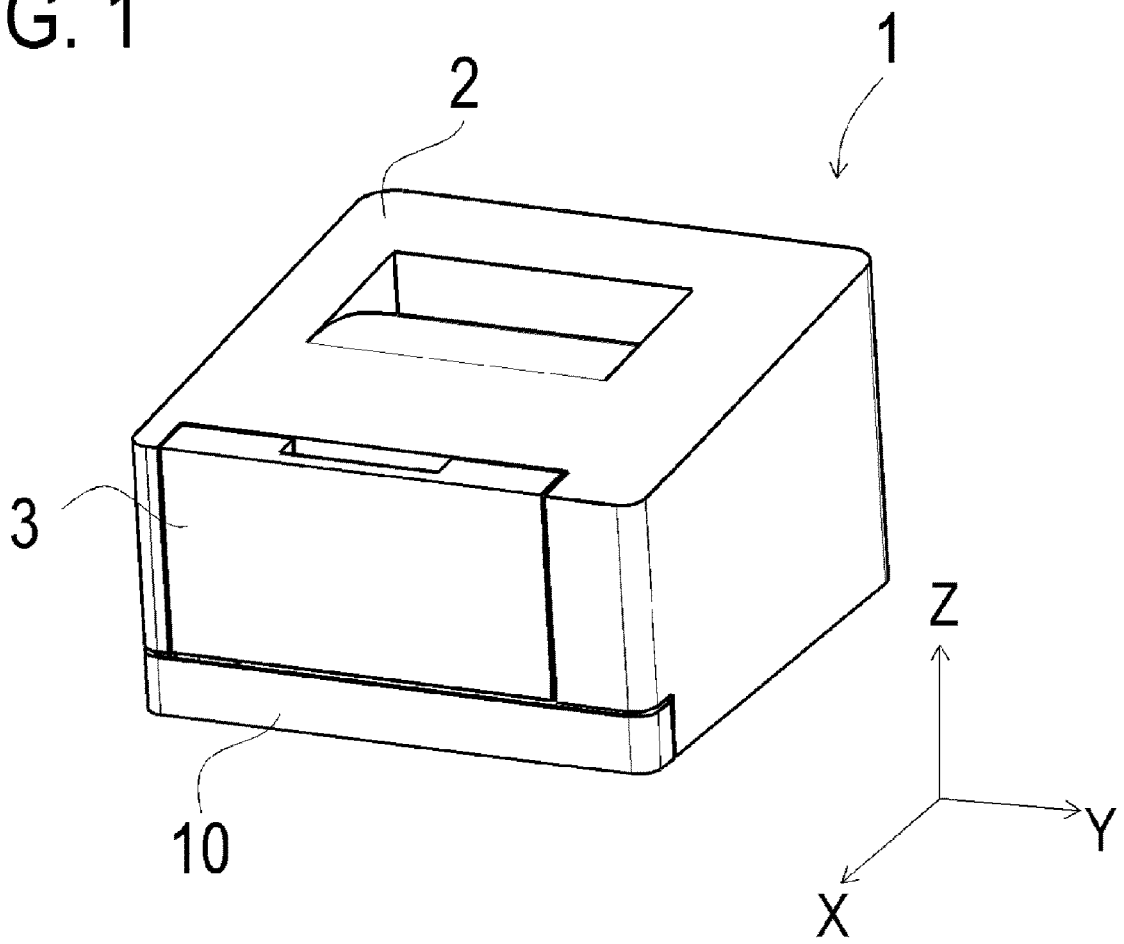
FIG. 1 is a schematic perspective view for explaining an external configuration of an image forming apparatus according to a first embodiment.
Figure 2:
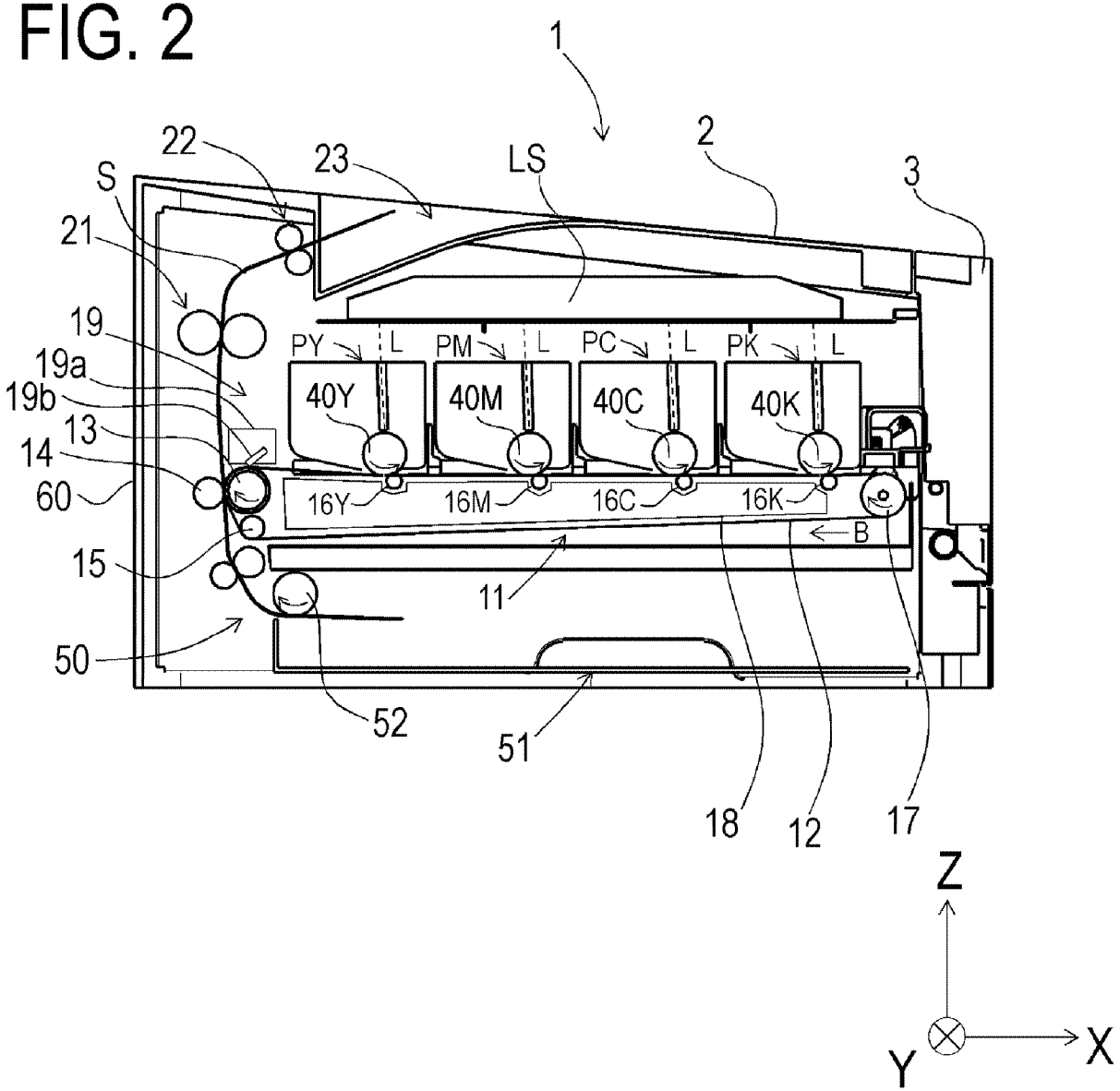
FIG. 2 is a schematic sectional view for explaining an internal configuration of the image forming apparatus according to the first embodiment.

FIG. 1 is a schematic perspective view for explaining an external configuration of an image forming apparatus 1 according to the present embodiment, and FIG. 2 is a schematic sectional view showing an internal configuration of the image forming apparatus 1. The image forming apparatus 1 according to the present embodiment is a so-called tandem-type image forming apparatus having a plurality of image forming portions PY, PM, PC, and PK. The first image forming portion PY forms an image with yellow (Y) toner, the second image forming portion PM with magenta (M) toner, the third image forming portion PC with cyan (C) toner, and the fourth image forming portion PK with black (Bk) toner.

In addition, the image forming apparatus 1 adopts a process cartridge system and the plurality of image forming portions PY, PM, PC, and PK are respectively configured as process cartridges (a plurality of cartridges) to be attachable to and detachable from an apparatus main body 2. Detaching or attaching each process cartridge is performed in a state where an opening/closing door 3 provided on the image forming apparatus 1 is open. As shown in FIG. 2, the four image forming portions are arranged in a single row at regular intervals and, with the exception of the colors of toners, the configurations of the respective image forming portions have many substantially common portions. Therefore, in the following description, unless the elements must be distinguished from one another, the suffixes Y, M, C, and K added to the reference characters to represent which color is to be produced by which element will be omitted and the elements will be collectively described.

In addition, in the following description, with respect to the image forming apparatus 1, it is assumed that a side on which the opening/closing door 3 is provided is the front (a front surface) and a surface opposite to the front is the rear (a back surface). Furthermore, a right side of the image forming apparatus 1 as viewed from the front will be referred to as a driven side and a left side will be referred to as a non-driven side. Moreover, in the drawings, a direction from the rear toward the front of the apparatus main body 2 will be defined as an X axis direction, a direction from the non-driven side toward the driven side of the main body will be defined as a Y axis direction, and a direction from a bottom surface toward a top surface of the apparatus main body 2 will be defined as a Z axis direction.

As shown in FIG. 2, each image forming portion P is arranged in a horizontal row with respect to the bottom surface of the apparatus main body 2. The image forming portion P has an electrophotographic process mechanism to which a rotational driving force is transmitted from a cartridge drive transmitting portion (not illustrated) provided on the apparatus main body 2. The image forming portion P includes a plurality of photosensitive drums 40 (40Y, 40M, 40C, and 40K) as image bearing members for bearing a toner image (a plurality of image bearing members), charging members (not illustrated), and developing units (not illustrated).

In addition, an exposing unit LS is provided above the image forming portion P in the Z axis direction and the exposing unit LS outputs laser light L in correspondence to image information received by a controller (not illustrated). The laser light L output from the exposing unit LS passes through an exposure window portion of the image forming portion P and scans and exposes a surface of the photosensitive drum 40.

Furthermore, a transfer unit 11 as transfer portion is provided below the image forming portion P in the Z axis direction. The transfer unit 11 includes an endless intermediate transfer belt 12 which is movable in a direction of an arrow B in the drawing, a primary transfer roller 16, a driver roller 13, a storage container 18, a tension roller 17, an assist roller 15, and a collecting unit 19. By receiving a driving force and rotating, the driver roller 13 moves the intermediate transfer belt 12 in the direction of the arrow B in the drawing and tautens the intermediate transfer belt 12 together with the tension roller 17 and the assist roller 15. Details of the belt tensioning mechanism in the tension roller 17 will be described later. The collecting unit 19 collects toner remaining on the intermediate transfer belt 12 and the toner collected by the collecting unit 19 is stored in the storage container 18 which is provided in a region constituted by an inner circumferential surface of the intermediate transfer belt 12. In the present configuration, the storage container 18 functions as a frame in the transfer unit 11.

The primary transfer roller 16 is a transfer member which is provided in plurality and which is used to transfer the toner image being borne by the photosensitive drum 40 to the intermediate transfer belt 12 from the photosensitive drum 40, and the primary transfer rollers 16 are in contact with the inner circumferential surface of the intermediate transfer belt 12 as a plurality of transfer members. Each of the primary transfer rollers 16Y, 16M, 16C, and 16K is provided so as to correspond to each of the photosensitive drums 40Y, 40M, 40C, and 40K via the intermediate transfer belt 12. Each primary transfer roller 16 is provided so as to extend in a direction orthogonal to the direction of the arrow B in the drawing or, in other words, the Y axis direction and is provided in an arrangement in which the primary transfer rollers 16 are lined up at intervals in a direction approximately parallel to the X axis. Each primary transfer roller 16 forms a primary transfer portion which biases the intermediate transfer belt 12 toward each photosensitive drum 40 and in which the photosensitive drum 40 and the intermediate transfer belt 12 come into contact with each other. In this manner, the intermediate transfer belt 12 is sandwiched between each photosensitive drum 40 and each primary transfer roller 16.

In the present embodiment, as shown in FIG. 2, each primary transfer roller 16 is arranged displaced with respect to a position of each primary transfer portion at which each photosensitive drum 40 and the intermediate transfer belt 12 come into contact with each other. More specifically, each primary transfer roller 16 is arranged so as to be shifted toward a downstream side than the position of each primary transfer portion with respect to a moving direction of the surface of the intermediate transfer belt 12. Alternatively, each primary transfer roller 16 may be arranged so as to be shifted toward an upstream side than the position of each primary transfer portion.

The collecting unit 19 has a frame body 19*a* and a cleaning blade 19*b* (a collecting member) which is provided inside the frame body 19*a* and which extends in the Y axis direction. The cleaning blade 19*b* is arranged so as to abut an outer circumferential surface of the intermediate transfer belt 12 in a counter direction opposing the moving direction of the surface of the intermediate transfer belt 12 and collects the toner remaining on the intermediate transfer belt 12 into the frame body 19*a*.

A secondary transfer roller 14 is arranged at a position opposing the driver roller 13 (a driving rotating member) via the intermediate transfer belt 12 and a secondary transfer portion is formed at a position where the secondary transfer roller 14 and the intermediate transfer belt 12 abut each other. In addition, a feeding unit 50 having a paper feeding cassette 51 which houses a transfer material S and a paper feeding roller 52 which feeds the transfer material S from the paper feeding cassette 51 toward the secondary transfer portion is provided on an upstream side of the secondary transfer portion with respect to a conveying direction of the transfer material S.

A fixing unit 21 which fixes a toner image on the transfer material S and a discharge roller pair 22 which discharges the transfer material S on which the toner image has been fixed from the apparatus main body 2 are provided on a downstream side of the secondary transfer portion with respect to the conveying direction of the transfer material S. The transfer material S discharged from the apparatus main body 2 by the discharge roller pair 22 is stacked on a paper discharge tray 23.

Image Forming Operation

Next, an image forming operation by the image forming apparatus 1 according to the present embodiment will be explained. Reception of an image signal by control unit (not illustrated) such as a controller starts the image forming operation and the photosensitive drum 40, the driver roller 13, and the like start rotating at a prescribed peripheral velocity (process speed) due to a driving force from a driving source (not illustrated).

A surface of the photosensitive drum 40 is uniformly charged to a same polarity as a normal charging polarity (in the present embodiment, a negative polarity) of toner by charging members (not illustrated). Subsequently, by being irradiated with laser light L from the exposing unit LS, an electrostatic latent image in accordance with the image information is formed. In addition, the electrostatic latent image formed on the photosensitive drum 40 is developed by toner stored in developing units (not illustrated) and a toner image in accordance with the image information is borne on the surface of the photosensitive drum 40. At this point, a toner image in accordance with an image component of each color of yellow, magenta, cyan, and black is borne on each of the photosensitive drums 40Y, 40M, 40C, and 40K.

Subsequently, the toner image of each color being borne by each photosensitive drum 40 reaches each primary transfer portion with the rotation of each photosensitive drum 40. In addition, due to voltage applied to each primary transfer roller 16 from a power supply (not illustrated), the toner image of each color being borne by each photosensitive drum 40 is sequentially overlaid and primarily transferred to the intermediate transfer belt 12 in each primary transfer portion. Accordingly, toner images of four colors which correspond to an object color image are formed on the intermediate transfer belt 12.

In addition, the toner images of four colors which are borne by the intermediate transfer belt 12 reach the secondary transfer portion with a movement of the intermediate transfer belt 12 and are collectively transferred to a surface of the transfer material S being a sheet of paper, an OHP sheet, or the like during the process of passing through the secondary transfer portion. At this point, a voltage with an opposite polarity to the normal charging polarity of toner is applied to the secondary transfer roller 14 from a secondary transfer power supply (not illustrated).

The transfer material S stored in the paper feeding cassette 51 is fed from the paper feeding cassette 51 at a prescribed timing by the paper feeding roller 52 and conveyed toward the secondary transfer portion. In addition, when the transfer material S to which the toner images of four colors have been transferred at the secondary transfer portion is heated and pressurized by the fixing unit 21, the toners of four colors are fused and mixed and fixed to the transfer material S. Subsequently, the transfer material S is discharged from the apparatus main body 2 by the discharge roller pair 22 and stacked on the paper discharge tray 23 as a stacking portion.

Toner (hereinafter, referred to as untransferred toner) remaining on the intermediate transfer belt 12 after secondary transfer is removed from the surface of the intermediate transfer belt 12 by the collecting unit 19 which is provided so as to oppose the driver roller 13 via the intermediate transfer belt 12. In the image forming apparatus 1 according to the present embodiment, a full-color print image is formed by the operation described above.

It should be noted that the image forming apparatus 1 according to the present embodiment is mounted with a controller (not illustrated) for controlling operations of the respective portions of the image forming apparatus, a memory (not illustrated) as a storing unit which stores various types of control information, and the like. The controller executes control related to conveyance of the transfer material S, control related to driving of the intermediate transfer belt 12 and each image forming portion P as a process cartridge, control related to image formation, and the like.

Supporting Structure and Creep Prevention Shape of Transfer Portion

Figure 3:
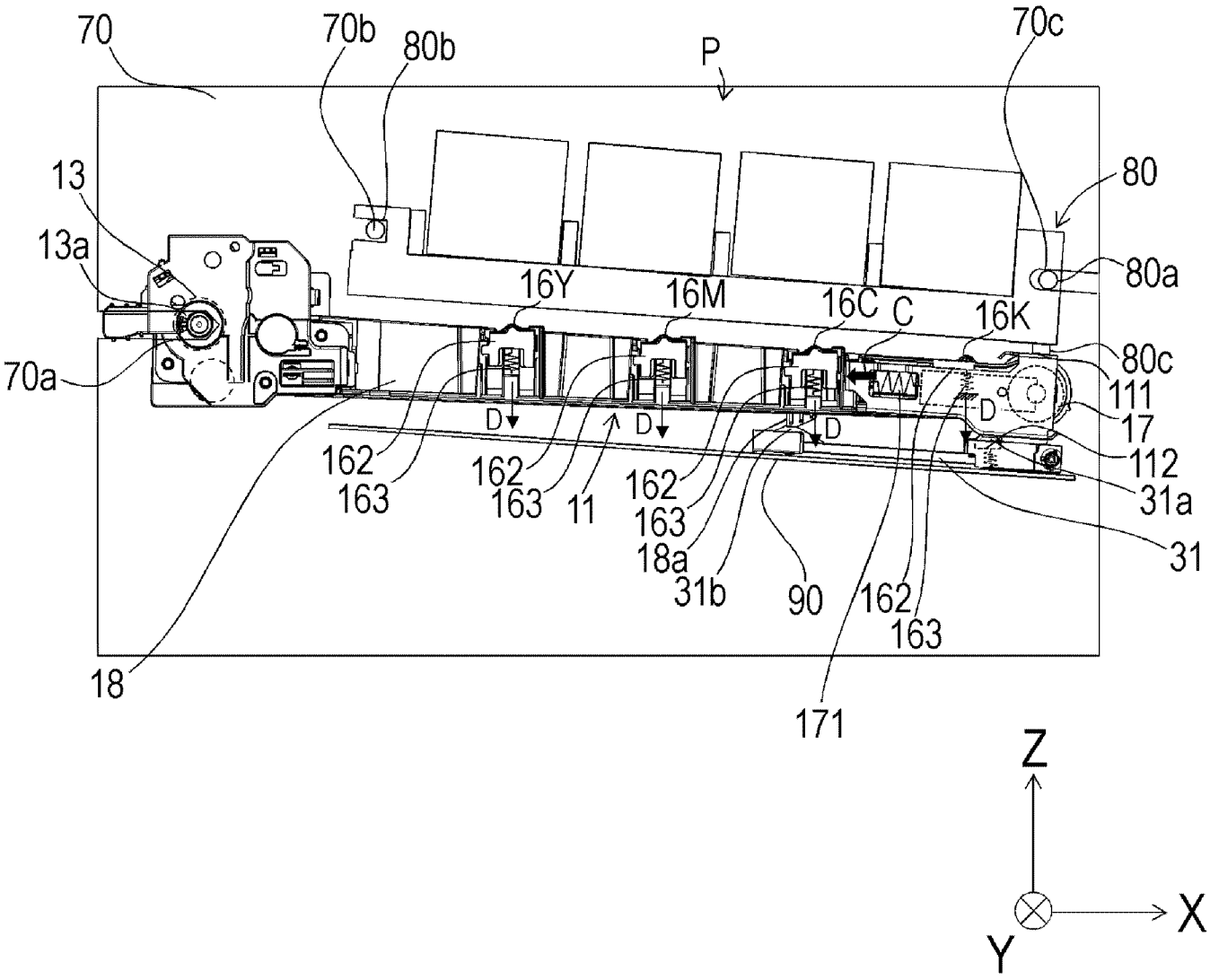
FIG. 3 is a schematic sectional view for explaining a support structure of transfer portion according to the first embodiment.

FIG. 3 shows a supporting structure of the transfer unit 11 (transfer portion) in the image forming apparatus 1 (the intermediate transfer belt 12 is not illustrated in FIG. 3). A driver roller bearing 13*a* coaxially provided with the driver roller 13 is rotatably supported with respect to a main body side plate 70. Specifically, the transfer unit 11 is inserted in the +X direction and held by pressure exerted by the secondary transfer roller 14 (not illustrated in FIG. 3) with respect to a slit portion 70*a* which is provided on the main body side plate 70.

In addition, a process cartridge tray 80 for housing the process cartridge P is inserted from the front of the main body. The process cartridge tray 80 is supported by the main body side plate 70 due to an engagement of a tray slit 80*b* with respect to a side plate pin 70*b* and an engagement of a tray pin 80*a* with respect to a side plate slit 70*c* provided on the main body side plate 70. The transfer unit 11 being supported so as to be movable in the X axis direction is pressed in the +Z direction by a pressing portion 31*a* of a rail member 31 which is provided on a main body stay 90 being fixed to and held by the main body side plate 70. In addition, movement in the Z axis direction of the transfer unit 11 is restricted as the transfer unit 11 abuts against a tray contact region 80*c* provided on the process cartridge tray 80. In this manner, the transfer unit 11 is positioned with respect to the main body side plate 70 via the process cartridge tray 80 on an XZ plane. The pressing portion 31*a* corresponds to the first supporting portion which supports a region of the transfer unit 11 on a side of one end portion relative to the intermediate transfer belt in an arrangement direction of the primary transfer roller 16. Furthermore, the driver roller bearing 13*a* described above corresponds to the second supporting portion which supports a region of the transfer unit 11 on a side of other end portion relative to the intermediate transfer belt 12 according to the present embodiment in the arrangement direction of the primary transfer rollers 16.

A belt tensioning mechanism and a pressing mechanism during toner image transfer described below are provided inside the storage container 18 of the transfer unit 11. More specifically, the tension roller 17 is pressed in the +X direction by a tension spring 171 and, as a result, the storage container 18 receives a force in a direction of an arrow C. Furthermore, when the primary transfer roller 16 presses the intermediate transfer belt 12 via a primary transfer bearing 162 due to a primary transfer spring 163 as a biasing member, the storage container 18 receives a force in a direction of an arrow D from each primary transfer roller 16. Therefore, due to a resultant force of the forces in the directions of the arrows C and D, the storage container 18 receives a force in the −Z direction. When creep is reproduced by high-temperature storage in a state where the transfer unit 11 is only supported by a lower contact portion 112 and the driver roller bearing 13*a*, an amount of deformation in the −Z direction of the storage container 18 is maximized directly under the primary transfer rollers 16M and 16C.

In order to suppress the creep, in an arrangement configuration viewed in the Y axis direction as in FIG. 3, the supporting structure of the storage container 18 is desirably provided directly under a section from the primary transfer rollers 16M to 16C in the X axis direction in the storage container 18. In the present embodiment, a supported portion 18*a* is provided as a part of the storage container 18 and a supporting portion 31*b* is provided as a part of the rail member 31 in the apparatus main body. Since the rail member 31 is provided grounded to the main body stay 90, deformation of the storage container 18 which doubles as a frame of the transfer unit 11 as described earlier can be supported by the main body stay 90 due to the supported portion 18*a* and the supporting portion 31*b* of the rail member 31. In other words, the supporting portion 31*b* corresponds to the biasing force receiving portion which is capable of supporting the transfer unit 11 (the storage container 18) between the pressing portion 31*a* being the first supporting portion and the driver roller bearing 13*a* being the second supporting portion described earlier.

Figure 4:
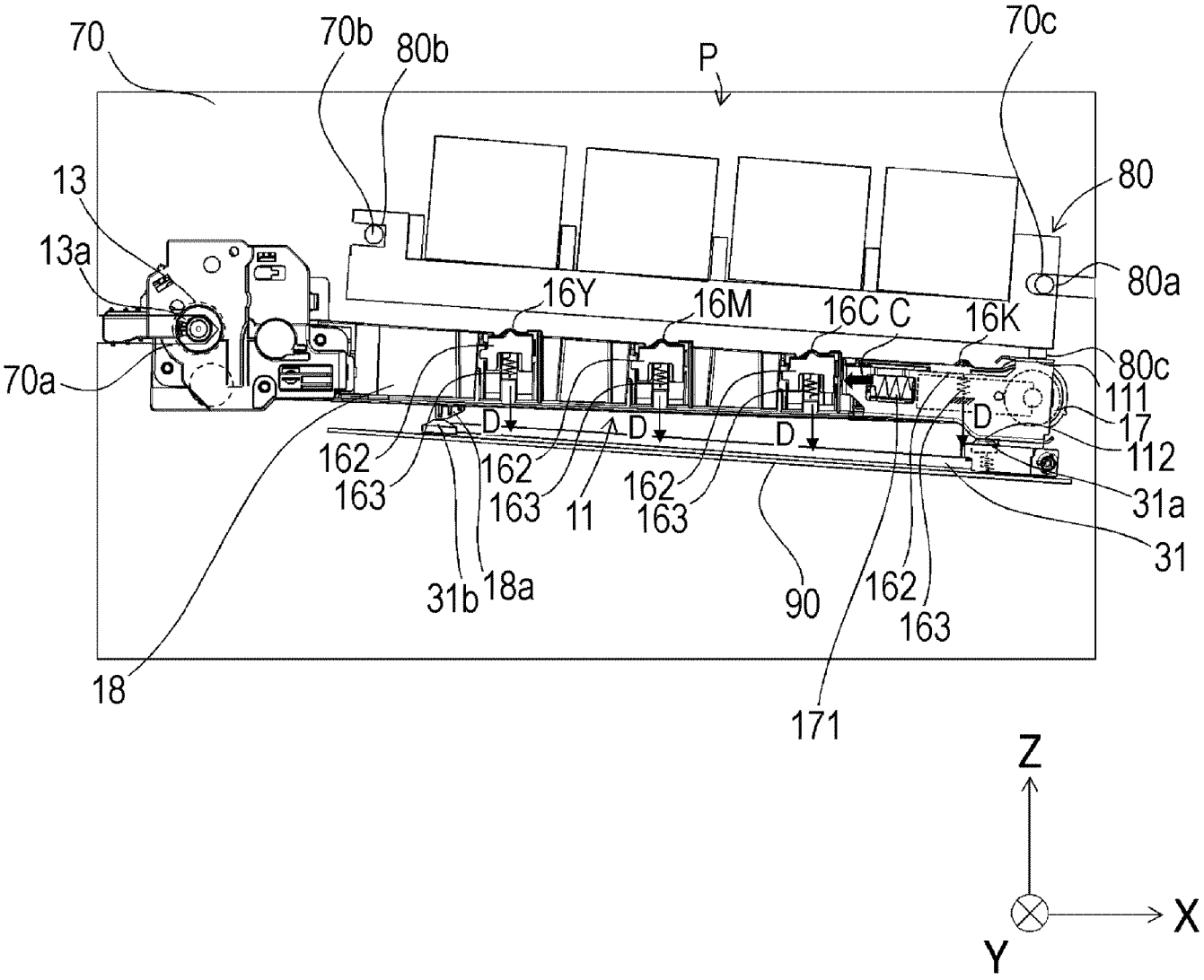
FIG. 4 is a schematic sectional view for explaining the support structure of the transfer portion according to the first embodiment.

A feature of the present embodiment is that deformation of the transfer unit 11 (the storage container 18) is suppressed by the supporting portion 31*b*. Accordingly, a new mechanism for creep suppression is not necessary and creep suppression can be performed using the supported portion 18*a* which constitutes a part of the storage container 18 and the supporting portion 31*b* which is provided on the rail member 31. As described earlier, the position where the supporting structure is provided is desirably directly under a section from the primary transfer rollers 16M to 16C in the storage container 18 (a position which overlaps with the section from the primary transfer rollers 16M to 16C in a positional relationship in the X axial direction (the arrangement direction of the primary transfer rollers 16, the moving direction of the surface of the intermediate transfer belt 12)). In other words, the position where the supporting structure is provided is desirably below the section from the primary transfer rollers 16M to 16C in a direction orthogonal to the moving direction of the surface of the intermediate transfer belt 12. Alternatively, the position is desirably directly under (below) the primary transfer roller 16M or 16C. This is because a deformation amount due to creep is maximized directly under the primary transfer rollers 16M and 16C which is a location respectively separated from the pressing portion 31*a* supporting the side of one end portion and the driver roller bearing 13*a* supporting the side of other end portion of the transfer unit 11 (the storage container 18) in the X axis direction. However, the supporting structure is not limited to directly under a section from the primary transfer rollers 16M to 16C in the storage container 18 and an effect can be produced even when the supporting portion 31*b* is provided at any position in a section in the X axis direction from the driver roller bearing 13*a* where the transfer unit 11 is supported to the pressing portion 31*a*. In other words, as shown in FIG. 4 (the intermediate transfer belt 12 is not illustrated in FIG. 4), the supported portion 18*a* and the supporting portion 31*b* may be provided so that positions in the X axis direction are positions between the driver roller bearing 13*a* and the primary transfer roller 16Y. In addition, a sufficient effect may be produced by providing the supporting portion 31*b* as a biasing force receiving portion so that a position thereof in the X axis direction is a position that at least overlaps with the intermediate transfer belt 12. Furthermore, by providing the supporting portion 31*b*, a configuration is also possible in which the transfer unit 11 is positioned with respect to the apparatus main body by the driver roller bearing 13*a* and the supporting portion 31*b* while suppressing deformation by creep with the supporting portion 31*b* without providing the pressing portion 31*a*.

While positions of the supported portion 18*a* and the supporting portion 31*b* are desirably restricted by causing the supported portion 18*a* and the supporting portion 31*b* to make contact from the perspective of creep suppression performance, a gap may be provided in a contactless manner. Although providing the gap is to allow creep corresponding to the gap, a configuration can be adopted in which the gap is provided in order to suppress further creep in the −Z direction. In other words, in an initial stage of use of the transfer unit 11, a configuration may be adopted in which the supported portion 18*a* and the supporting portion 31*b* are not in contact with each other. Alternatively, a configuration may be adopted in which the supported portion 18*a* and the supporting portion 31*b* interfere with each other, and although the storage container 18 is to receive a force in the +Z direction, any configuration may be selected as long as positional accuracy of the transfer unit 11 allows such a configuration.

It should be noted that, in the present embodiment, residual toner is collected by the collecting unit 19 provided inside the transfer unit 11 as described earlier and the collecting unit 19 is also effective as means for restricting displacement in the −Z direction in accordance with a weight of the residual toner. Even from the perspective of the weight of the residual toner, a supporting structure is desirably provided directly under a section from the primary transfer rollers 16M to 16C as a portion close to approximately center of the storage container 18 in the X axis direction. By supporting the storage container 18 which is expected to deform due to the weight of the residual toner with the main body stay 90 via the supported portion 18*a* and the supporting portion 31*b*, since there are fewer interposing components and a smaller effect due to component precision, a deformation suppression effect can be produced in a stable manner. In addition, even in a configuration in which the transfer unit 11 does not have the storage container 18, a creep suppression effect can be produced by providing the transfer unit 11 with the present configuration.

Due to the configuration, freedom of selection of a material of the storage container 18 which doubles as the frame of the transfer unit 11 improves. In other words, even without providing resin material, a metal frame, or the like with high rigidity, creep can be suppressed by adopting the supporting structure described above.

Figure 5:
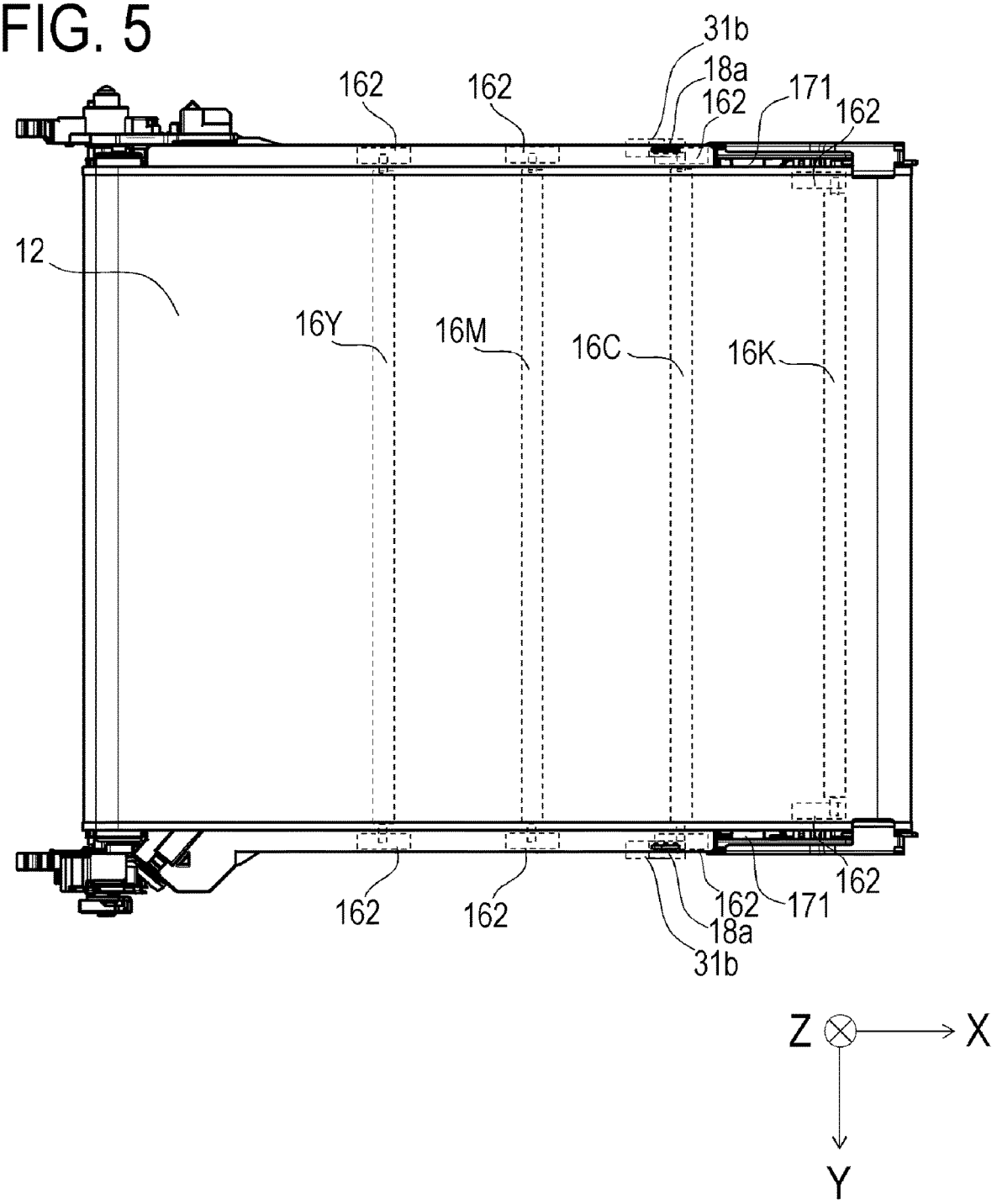
FIG. 5 is a schematic bottom view for explaining the support structure of the transfer portion according to the first embodiment.

FIG. 5 shows a view of the transfer unit 11 from a bottom surface, and both a driven side and a non-driven side of the supported portion 18*a* are provided on an outer side of the intermediate transfer belt 12 in the Y axis direction. The belt tensioning mechanism in the transfer unit 11 and the tension spring 171 and the primary transfer spring 163 which are used in the pressing mechanism during toner image transfer are provided on an approximately outer side of the transfer unit 11 in the Y axis direction. Therefore, the supported portion 18*a* which is a creep suppression member and the supporting portion 31*b* which supports the supported portion 18*a* are also desirably provided on an approximately outer side in the Y axis direction on a line of action of the biasing force.

Operation for Inserting/Extracting (Attaching/Detaching) Transfer Portion

Figure 6:
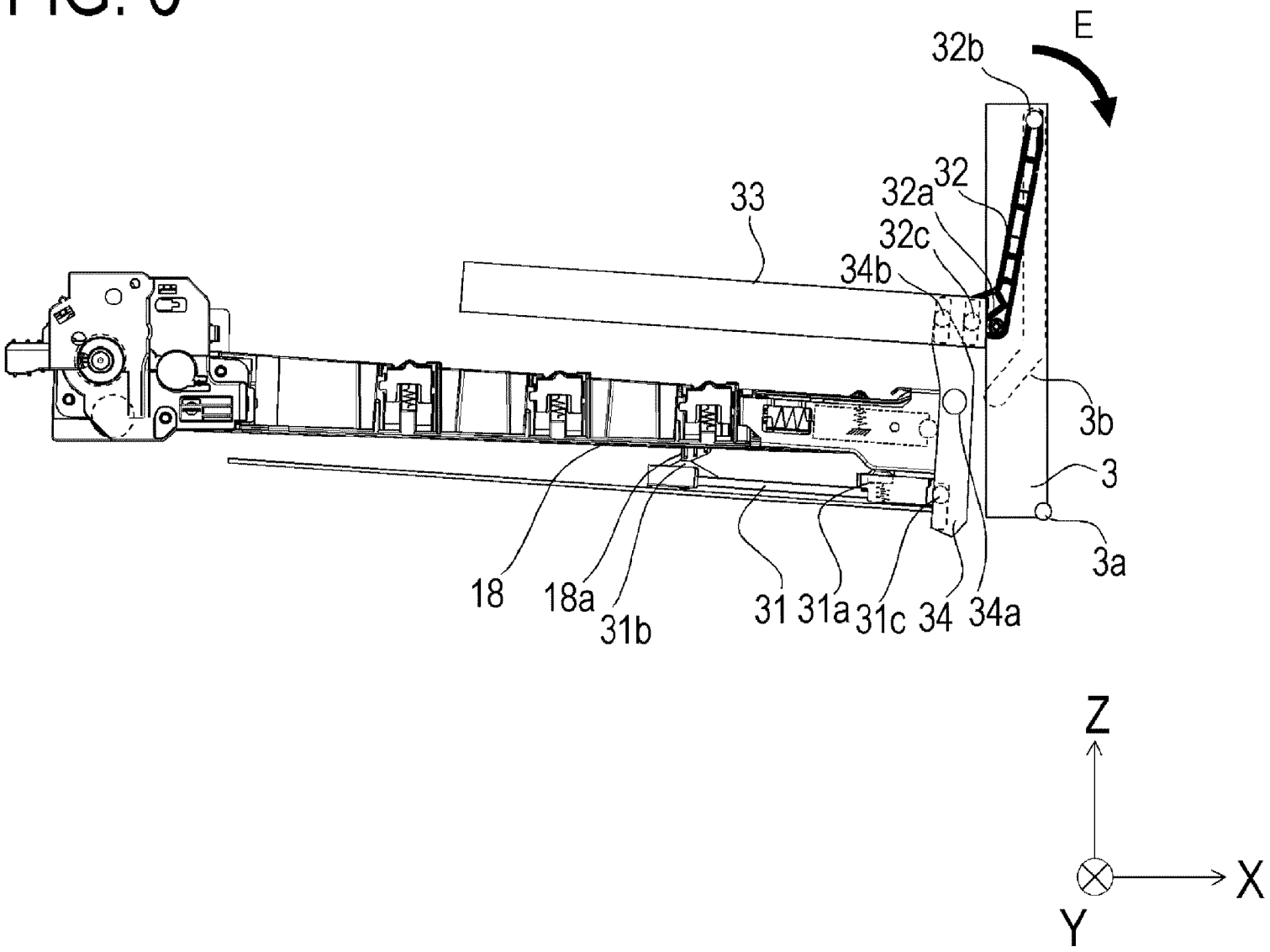
FIG. 6 is a schematic sectional view for explaining an operation of the transfer portion in conjunction with an opening/closing operation of a door.
Figure 7:
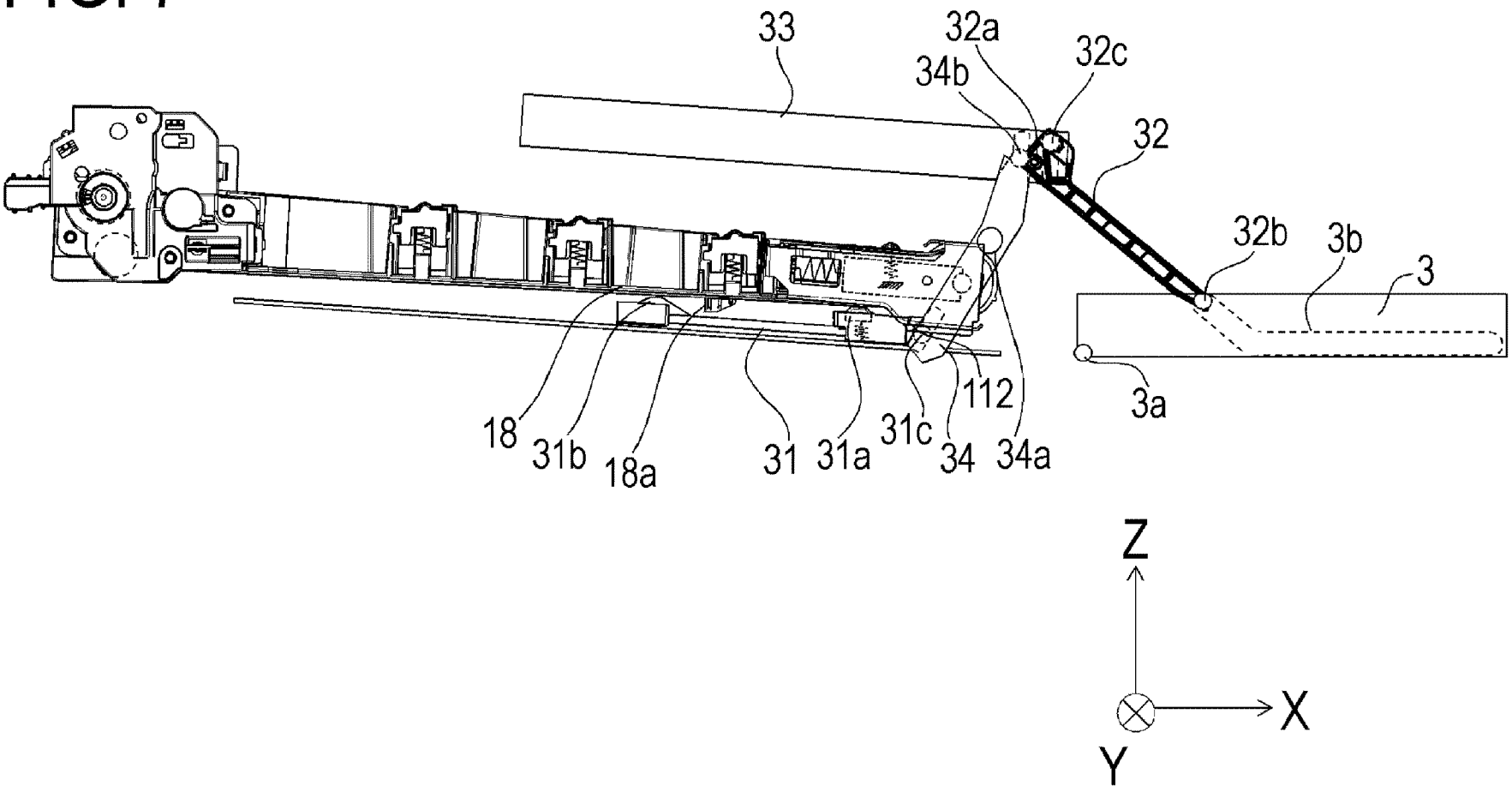
FIG. 7 is a schematic sectional view for explaining an operation of the transfer portion in conjunction with an opening/closing operation of a door.

As shown in FIGS. 6 and 7, the supporting portion 31*b* (biasing force receiving portion) for creep suppression is configured so as to be capable of abutting with and separating from the supported portion 18*a* in conjunction with an operation of the opening/closing door 3 as a first opening/closing member. FIG. 6 shows an operation of the transfer portion in conjunction with an operation of the opening/closing door during long-term storage and during image formation. In FIG. 6, the opening/closing door 3 is closed and a state (closed state) exists where the inside of the apparatus main body is not exposed. In this state, the transfer unit 11 is supported by the supporting portion 31*b* in a similar manner to the supporting structure shown in FIG. 3 and assumes a posture which enables creep suppression. At this point, the supporting portion 31*b* supports the transfer unit 11 at a support position. The rail member 31 which supports the storage container 18 of the transfer unit 11 is connected to the opening/closing door 3 via first to third door links (32 to 34).

Details of an operation of opening the opening/closing door 3 from the image forming apparatus in the closed state shown in FIG. 6 will be provided below. The opening/closing door 3 is provided with a rotational center 3*a*, a groove 3*b* and a boss 32*b* of the first door link 32 engage each other and work in conjunction with each other in an opening direction E of the opening/closing door 3 (CW direction), and the first door link 32 rotates in the CW direction around a rotational center 32*a*. A boss 32*c* of the first door link 32 engages with a groove of the second door link 33 and the second door link 33 linearly moves in approximately the +X direction. A boss 34*b* of the third door link 34 engages with a groove of the second door link 33 and the third door link 34 rotates in the CW direction around a rotational center 34*a*. Furthermore, a groove of the third door link 34 engages with a boss 31*c* of the rail member 31 and the rail member 31 linearly moves in approximately the −X direction. As a result, the transfer unit 11 rotates in the CW direction around the driver roller bearing 13*a*.

Due to the operation described above, the opening/closing door 3 opens as shown in FIG. 7 and the image forming apparatus enters a state (an open state) where the inside of the apparatus main body is exposed. In addition, the supporting portion 31*b* makes a transition to a posture (a retreated state) of retreating from and not supporting the supported portion 18*a* and moves to a non-supporting position where the supporting portion 31*b* does not support the transfer unit 11. At this point, the pressing portion 31*a* of the rail member 31 moves in the −X direction and separates from the lower contact portion 112 of the transfer unit 11, the position of the pressing portion 31*a* is restricted by a restricting member inside the rail member 31, and the transfer unit 11 is supported by the pressing portion 31*a*. Since a configuration is adopted in which the supporting portion 31*b* is distanced from the storage container 18 and the supported portion 18*a* is distanced from the rail member 31, the supporting portion 31*b* does not interfere with the storage container 18 and the supported portion 18*a* does not interfere with the rail member 31 and, consequently, the transfer unit 11 can be directly supported by the pressing portion 31*a* described earlier in an accurate manner. In the retreated state, the transfer unit 11 can be inserted to and extracted from (attached to and detached from) the apparatus main body, and insertion/extraction performance (attachment/detachment performance) is improved by providing inclined surfaces in the +X direction and the −X direction of the supporting portion 31*b*. Furthermore, assemblability during insertion is further improved by providing an inclined surface in the +X direction of the supported portion 18*a*.

Figure 8:
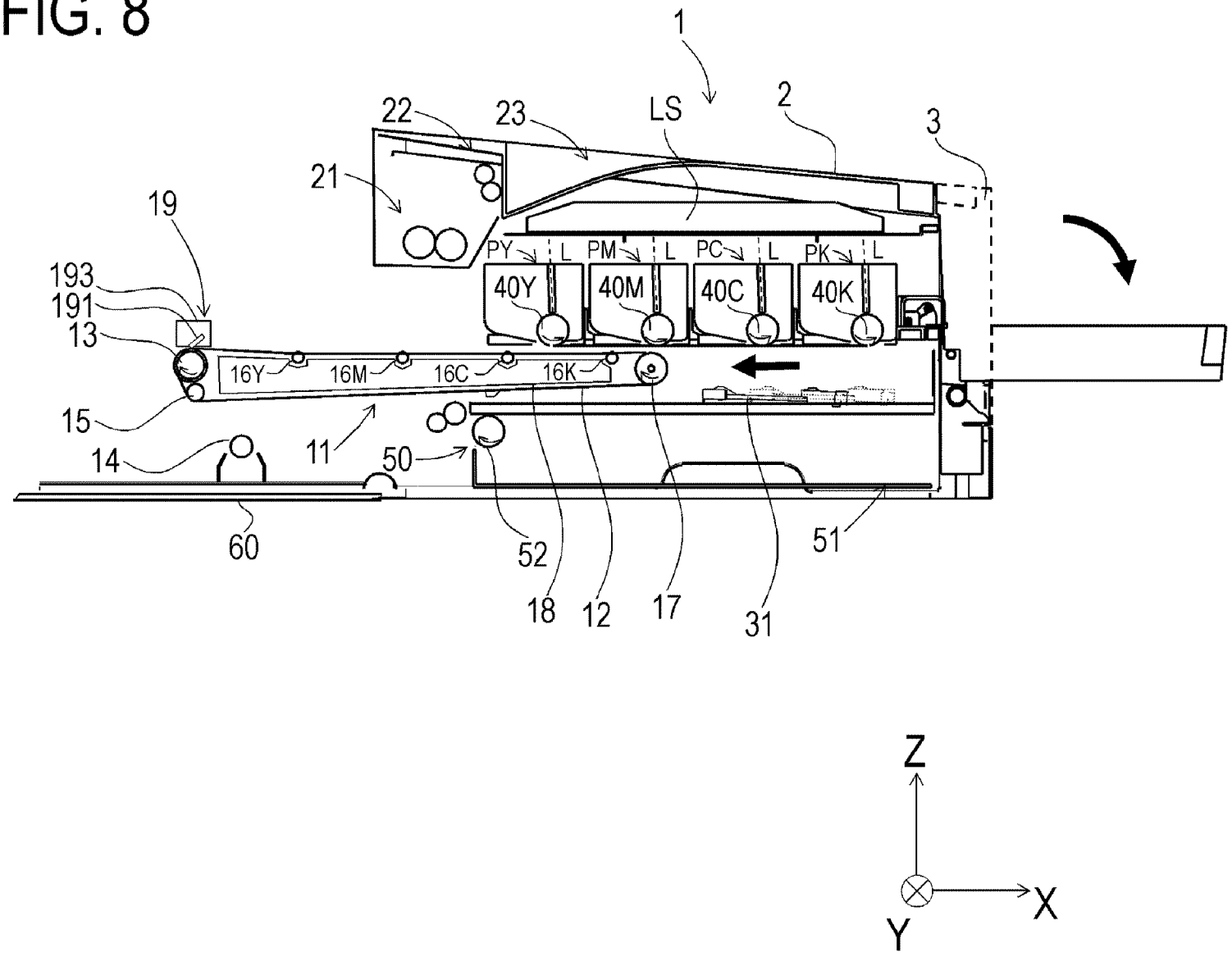
FIG. 8 is a schematic sectional view for explaining extraction of the transfer portion according to the first embodiment.

In the apparatus main body 2, by opening the opening/closing door 3 as shown in FIG. 8, the rail member 31 retreats (moves), the supporting portion 31*b* moves to the non-supporting position described earlier, and the transfer unit 11 enters a non-supported state. By opening a rear door 60 as a second opening/closing member which is provided at a position that differs from the opening/closing door 3 in this state, the transfer unit 11 can be extracted from the apparatus main body 2 by pulling the transfer unit 11 in the −X direction toward the main body rear surface. As described above, the configuration according to the present embodiment enables replaceability and insertion/extraction performance during assembly to be readily secured while providing a creep suppression function. On the other hand, a configuration is adopted in which, after inserting the transfer unit 11 into the apparatus main body 2, the supporting portion 31*b* automatically moves to the supporting position being a position where the supporting portion 31*b* can suppress creep in conjunction with a closing operation of the opening/closing door 3 to enable creep suppression to be realized without performing additional operations. While the supporting portion 31*b* is switchable between a supporting position and a non-supporting position in conjunction with an opening/closing operation of an opening/closing member, an operating panel (an operating portion) may be separately provided on the apparatus main body and an operation of the operating panel may enable switching between a supporting position and a non-supporting position to be performed.

Modification of Creep Prevention Shape

Next, other embodiments for enhancing the effect of the supported portion 18*a* and the supporting portion 31*b* according to the present embodiment will be explained with reference to FIGS. 9A and 9B to 12A to 12C. It should be noted that these configurations may be provided in addition to the configuration according to the first embodiment or in place of the configuration according to the first embodiment.

Second Embodiment

Figure 9A:
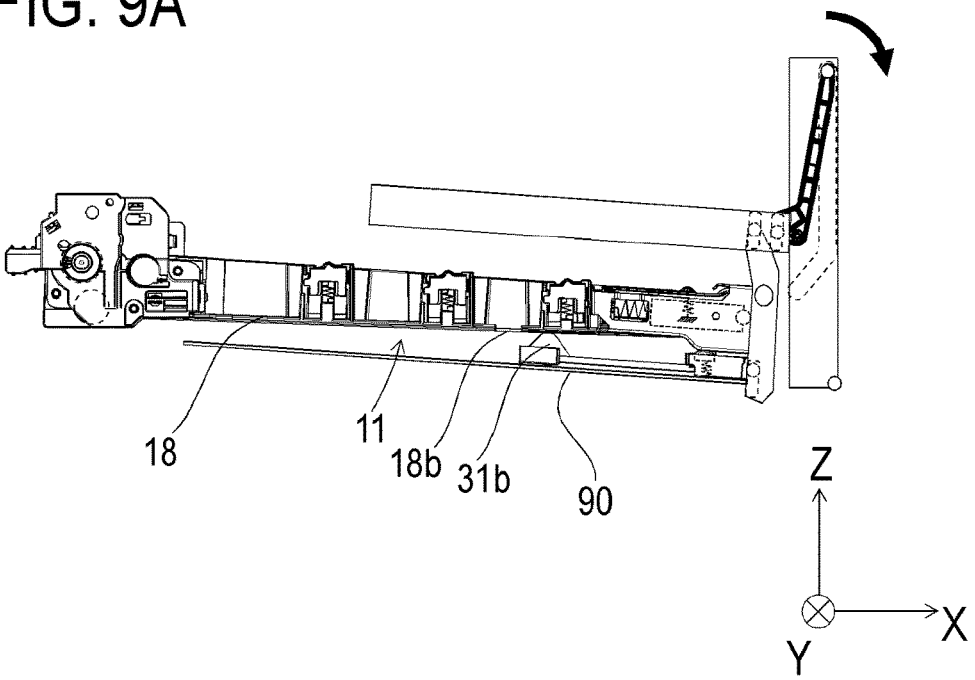
FIGS. 9A and 9B are schematic sectional views for explaining a support structure of transfer portion according to a second embodiment.
Figure 9B:
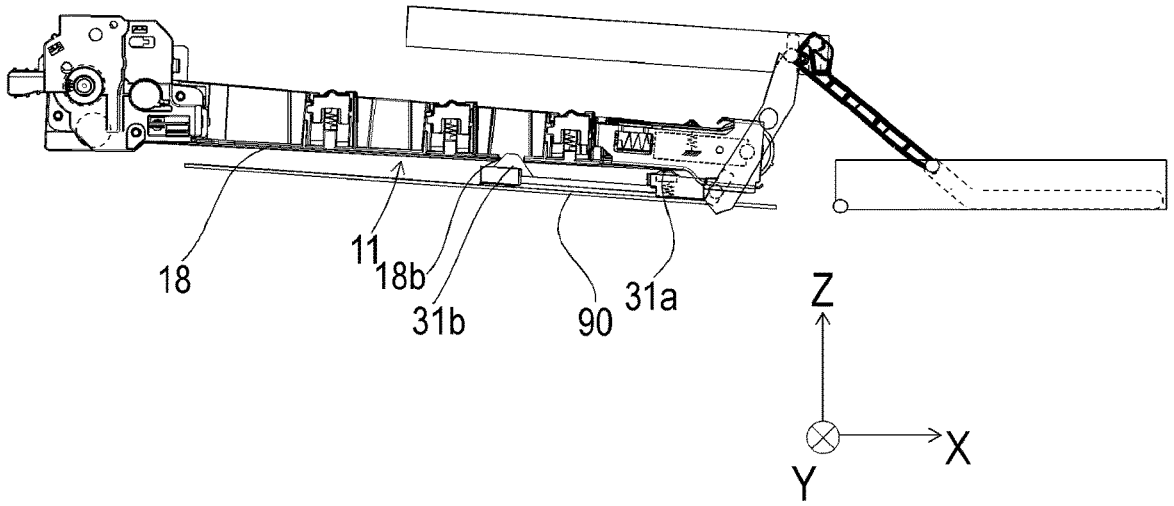

The present embodiment will be described with reference to FIGS. 9A and 9B. FIG. 9A is a diagram of a shape of a supporting portion necessary for creep suppression being provided only in the supporting portion 31*b* of the rail member 31 and shows a state during storage and image formation. Even in this configuration, since a force to be received by the transfer unit 11 can be received by the main body stay 90 through the supporting portion 31*b* of the rail member 31, a creep suppression effect is produced. As shown in FIG. 9B, opening the opening/closing door 3 causes the image forming apparatus to enter an open state and the supporting portion 31*b* retreats from the supporting position and moves to a non-supporting position. At this point, since the supporting portion 31*b* is inserted into a relief shape 18*b* (an opening portion) provided on the storage container 18, the supporting portion 31*b* does not interfere with the storage container 18. Therefore, the transfer unit 11 can be directly supported by the pressing portion 31*a* described earlier in an accurate manner. In addition, in the present example, the storage container 18 need not be provided with a projected shape such as the supported portion 18*a*. Furthermore, in the present embodiment, since the shape of the supporting portion 31*b* is provided with an inclined surface to enable the supporting portion 31*b* to slide against an edge of the relief shape 18*b* when the transfer unit 11 is being extracted, catching and the like can be prevented and insertion/extraction performance is further improved.

Third Embodiment

Figure 10A:
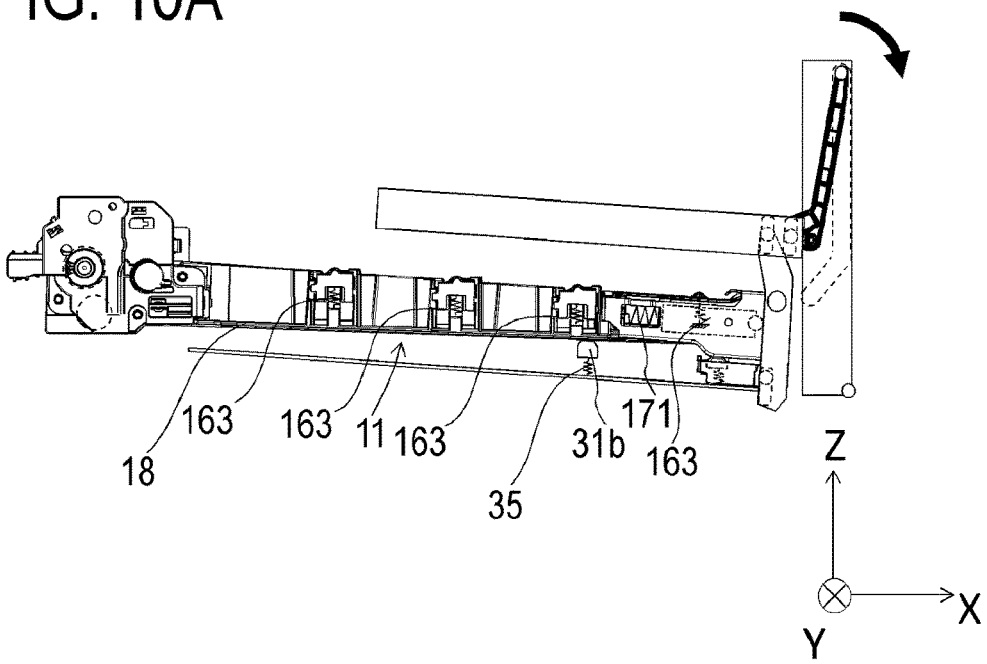
FIGS. 10A and 10B are schematic sectional views for explaining a support structure of transfer portion according to a third embodiment.
Figure 10B:
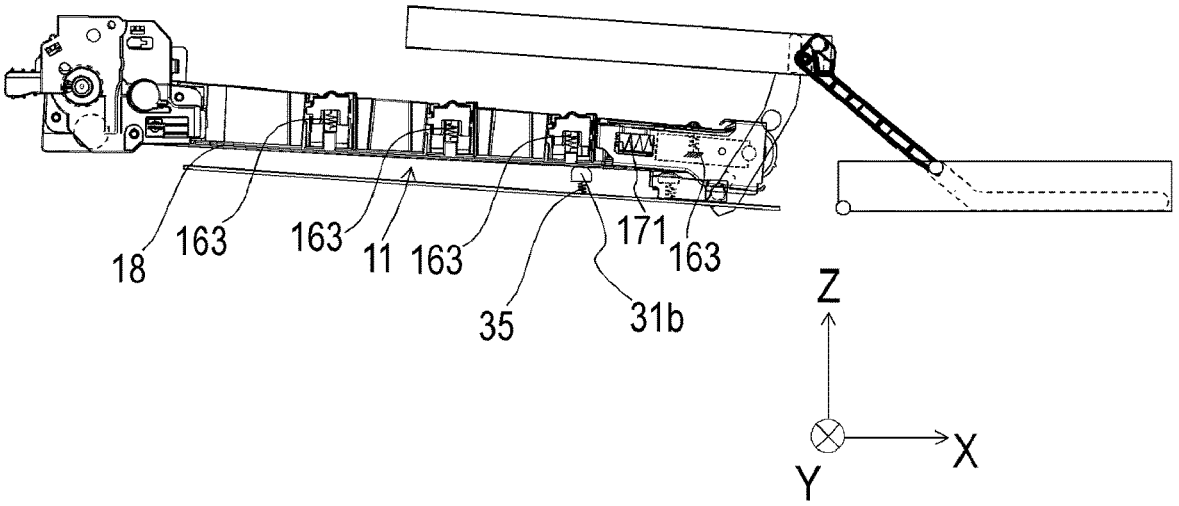

The present embodiment will be described with reference to FIGS. 10A and 10B. FIG. 10A shows a configuration of creep suppression in which a biasing member 35 is provided above the main body stay 90. During storage and image formation, the biasing member 35 (receiving portion biasing member) which biases the supporting portion 31*b* being a biasing force receiving portion abuts the storage container 18 from below in the Z axis direction and biases the storage container 18 in the +Z direction. According to this configuration, the transfer unit 11 counters, in the +Z direction, a resultant force of forces received from the tension spring 171 and the primary transfer spring 163 and suppresses creep deformation. In the present embodiment, the storage container 18 is directly biased by the supporting portion 31*b* provided with the biasing member 35. Therefore, positional accuracy such as positioning the supported portion 18*a* on a lower surface in the Z direction of the storage container 18 and the supporting portion 31*b* with each other need not be taken into consideration and an approximately constant biasing force in the +Z direction can be applied. In addition, as shown in FIG. 10B, when the image forming apparatus enters an open state and the transfer unit 11 is caused to retreat from the apparatus main body, an insertion/extraction operation of the transfer unit 11 can be performed while compressing the biasing member 35. In the configuration according to the present embodiment, only the biasing member 35 is provided as a creep suppression member. Therefore, unlike the first and second embodiments, the transfer unit 11 can be inserted and extracted without providing a mechanism for switching the supporting portion 31*b* between a supporting position where the transfer unit 11 is supported and a non-supporting position where the transfer unit 11 is not supported. In other words, the transfer unit 11 can be inserted and extracted and creep suppression can be performed with a simpler configuration.

Fourth Embodiment

Figure 11A:
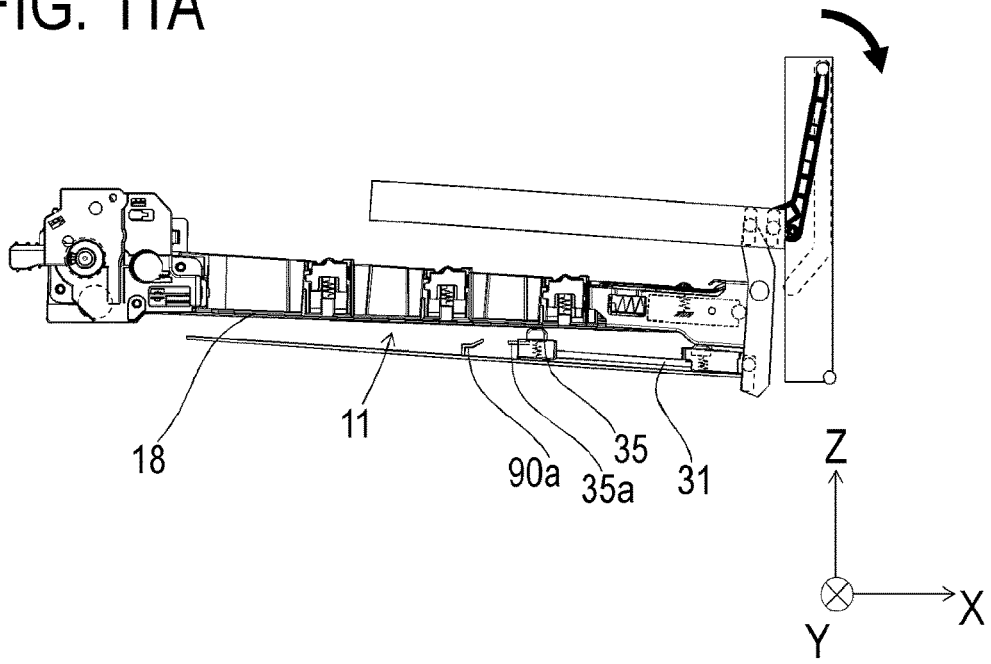
FIGS. 11A and 11B are schematic sectional views for explaining a support structure of transfer portion according to a fourth embodiment.
Figure 11B:
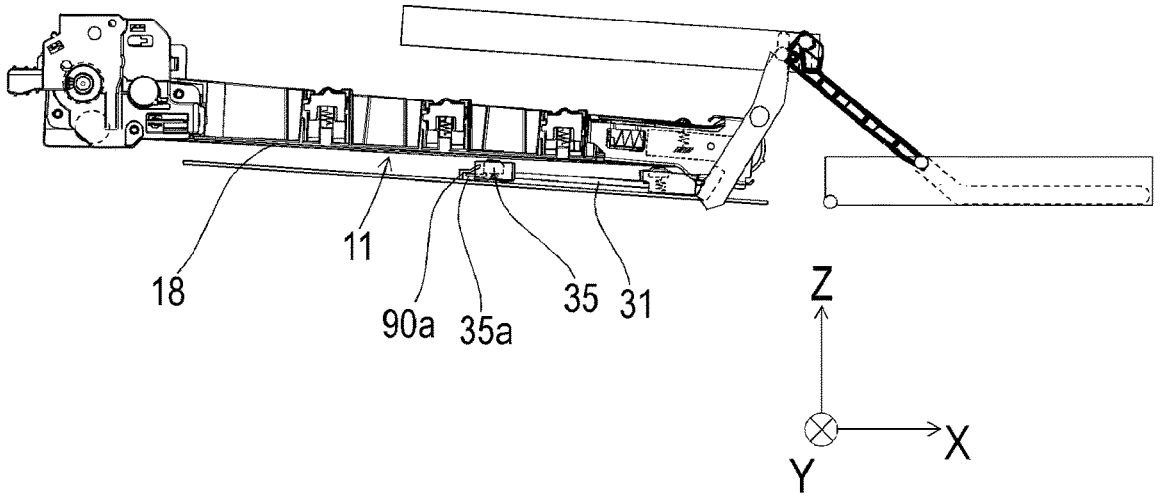

The present embodiment will be described with reference to FIGS. 11A and 11B. In FIGS. 11A and 11B, in addition to providing the biasing member 35 explained with reference to FIGS. 10A and 10B above the rail member 31, a guide portion 90*a* (a restricting portion) is provided which restricts movement of the biasing member 35 in the +Z direction when the image forming apparatus enters an open state and the transfer unit 11 is caused to retreat from the apparatus main body. During storage and image formation shown in FIG. 11A, the biasing member 35 abuts the storage container 18 from below in the Z axis direction and biases the storage container 18 in the +Z direction to suppress creep in a similar manner to FIG. 10A. Since the storage container 18 is directly biased by the biasing member 35 in a similar manner to the third embodiment, an approximately constant biasing force in the +Z direction can be applied regardless of the positional accuracy of the lower surface in the Z axis direction of the storage container 18. In addition, as shown in FIG. 11B, when the image forming apparatus enters an open state and the transfer unit 11 is caused to retreat from the apparatus main body, an engaging portion 35*a* provided on the biasing member 35 is to be restricted by the guide portion 90*a* provided on the main body stay 90. According to this configuration, the biasing member 35 moves in the −Z direction, a gap is created between the transfer unit 11 and the biasing member 35, and the biasing member 35 comes out of contact with the lower surface in the Z direction of the storage container 18. As described above, a configuration is adopted in which the insertion/extraction performance of the transfer unit 11 is further improved using the biasing member 35 as compared to the third embodiment.

Fifth Embodiment

Figure 12A:
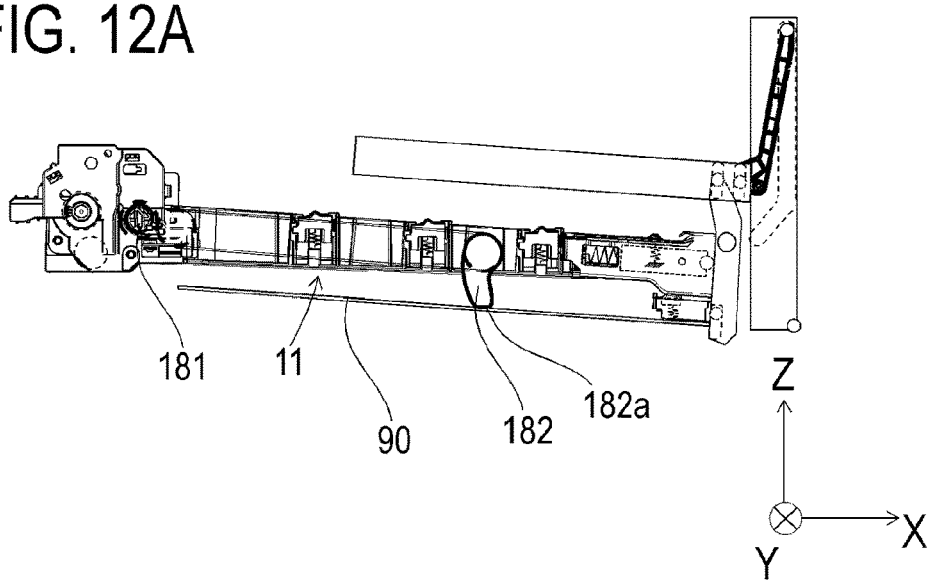
FIGS. 12A to 12C are schematic sectional views for explaining a support structure of transfer portion according to a fifth embodiment.
Figure 12B:
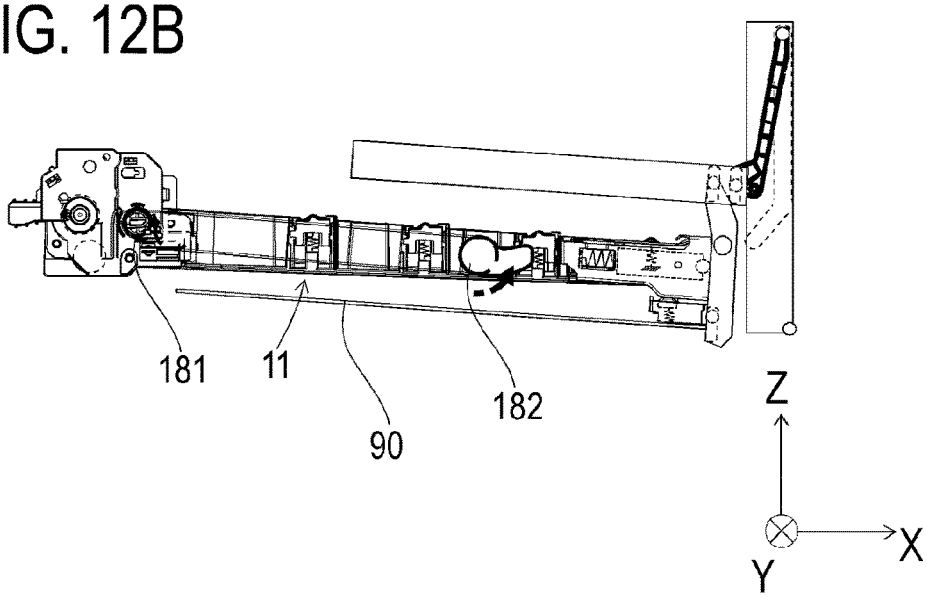
Figure 12C:
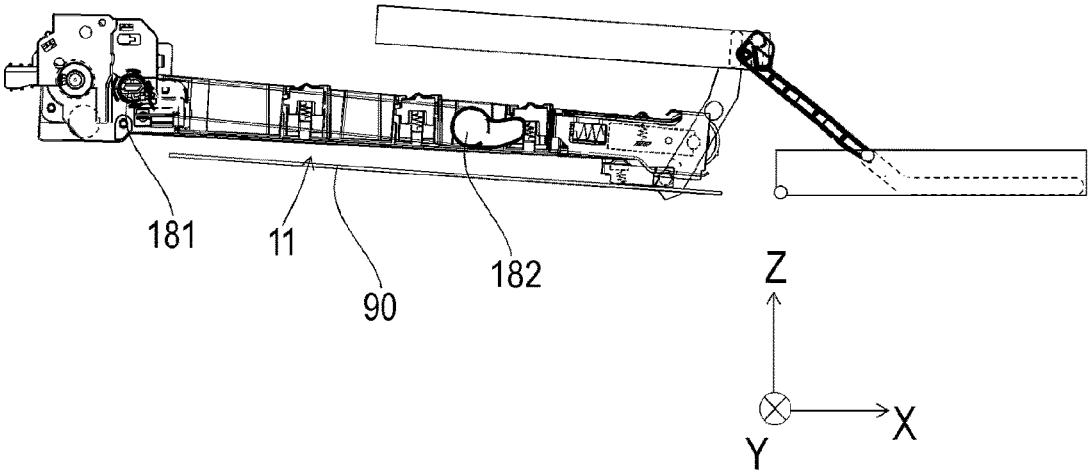

The present embodiment will be described with reference to FIGS. 12A to 12C. FIGS. 12A to 12C represent a configuration which enables selection of whether to support or not support the transfer unit 11 with a member for creep suppression when the image forming apparatus is in the closed state. As shown in FIG. 12A, in the configuration, a supporting cam 182 (a variable supporting cam) provided on the transfer unit 11 rotates upon receiving drive transmission from a coupling gear 181 which is coupled to a driving source (not illustrated) on a side of the main body. While the drive transmission from the coupling gear is implemented by gears and a belt drive in the present configuration, means for implementing the drive transmission is arbitrary such as using only gear couplings.

In this configuration, in a non-image formation mode such as when long-term storage or transport is anticipated, as shown in FIG. 12A, a tip portion 182*a* of the supporting cam 182 comes into contact with the main body stay 90 and the transfer unit 11 is supported. In addition, a phase (supporting phase) of the coupling gear 181 having received drive from the driving source is controlled so that the supporting cam 182 is at a position where creep deformation of the transfer unit 11 is suppressed.

On the other hand, during image formation, as shown in FIG. 12B, the supporting cam 182 rotates through the coupling gear with drive input from a main body-side driving source (not illustrated). In addition, the supporting cam 182 breaks off contact with the main body stay 90 and enters a phase (non-supporting phase) where the transfer unit 11 is not supported by the supporting cam 182. According to this configuration, in the transfer unit 11 which is positioned with respect to the main body side plate 70 through the process cartridge tray 80, interference during image formation can be avoided even if a dimensional relationship in which the transfer unit 11 interferes with the main body stay 90 when the supporting cam 182 comes into contact with the main body stay 90 is created due to dimensional accuracy. Therefore, the transfer unit 11 is not subjected to a force in the +Z direction and image accuracy can be prevented from being affected by deformation and a change in a backlash-removing direction in a supported portion such as the driver roller bearing 13*a*. As shown in FIG. 12C, since the supporting cam 182 is set to the non-supporting phase during insertion/extraction of the transfer unit 11 in a similar manner to during image formation, insertion/extraction performance is not affected.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2021-101096, filed on Jun. 17, 2021, which is hereby incorporated by reference herein in its entirety.

What is claimed is:

1. An image forming apparatus comprising:

a plurality of image bearing members;

a transfer unit including:

an intermediate transfer belt;

a plurality of transferring members that sandwich the intermediate transfer belt between the plurality of image bearing members and the plurality of transferring members;

a biasing member that biases each of the plurality of transferring members toward the plurality of image bearing members via the intermediate transfer belt; and a frame that supports the intermediate transfer belt, the plurality of transferring members, and the biasing member; and an apparatus main body that supports the plurality of image bearing members and the transfer unit, and including:

a supporting portion that supports the transfer unit; and a biasing force receiving portion disposed between the plurality of transferring members in a moving direction of a surface of the intermediate transfer belt, and configured to support the transfer unit, wherein the apparatus main body is configured to be movable between a supporting position where the transfer unit is supported and a non-supporting position where the transfer unit is not supported, wherein the apparatus main body further includes a first opening/closing member configured to:

perform a first opening/closing operation of switching between a first open state where an inside of the apparatus main body is exposed and a first closed state where the inside of the apparatus main body is not exposed; and move the biasing force receiving portion between the supporting position and the non-supporting position, wherein the first opening/closing member positions the biasing force receiving portion at:

the supporting position while the first opening/closing member is in the first closed state; and the non-supporting position while the first opening/closing member is in the first open state, wherein the apparatus main body further includes a second opening/closing member disposed at a position that differs from the first opening/closing member and configured to perform a second opening/closing operation of switching between a second open state where the inside of the apparatus main body is exposed and a second closed state where the inside of the apparatus main body is not exposed, and wherein the transfer unit is attachable to and detachable from the apparatus main body while the first opening/closing member is in the first open state and the second opening/closing member is in the second open state.

2. The image forming apparatus according to claim 1, wherein:

each of the plurality of transferring members is a rotatable transfer roller, and the biasing force receiving portion is configured to support the frame on an outer side of the intermediate transfer belt in an axial direction of the plurality of transferring members.

3. The image forming apparatus according to claim 1, further comprising:

a plurality of cartridges that include the plurality of image bearing members and that are attachable to and detachable from the apparatus main body, wherein the plurality of cartridges are attachable to and detachable from the apparatus main body in the first open state of the first opening/closing member.

4. The image forming apparatus according to claim 1, wherein the frame includes an opening portion into which the biasing force receiving portion at the non-supporting position is to be inserted at a position between the plurality of transferring members in the moving direction of the surface of the intermediate transfer belt.

5. The image forming apparatus according to claim 4, wherein the biasing force receiving portion includes an inclined surface that guides the transfer unit by sliding against an edge of the opening portion, in a state where the transfer unit is extracted from the apparatus main body at the non-supporting position.

6. The image forming apparatus according to claim 1, wherein:

the apparatus main body further includes a receiving portion biasing member that biases the biasing force receiving portion toward the transfer unit, and the biasing force receiving portion receives a biasing force from the receiving portion biasing member while the biasing force receiving portion is at the supporting position where the transfer unit is supported.

7. The image forming apparatus according to claim 1, wherein:

the apparatus main body further includes a receiving portion biasing member that biases the biasing force receiving portion toward the transfer unit, and the apparatus main body further includes a restricting portion that restricts biasing of the biasing force receiving portion by the receiving portion biasing member while the biasing force receiving portion is at the non-supporting position.

8. The image forming apparatus according to claim 1, wherein the transfer unit further includes a variable supporting cam configured to assume, while the first opening/closing member is in the first closed state:

a non-supporting phase where the variable supporting cam is not in contact with the apparatus main body; and a supporting phase where the variable supporting cam is in contact with the apparatus main body and the variable supporting cam is supported by the apparatus main body.

9. The image forming apparatus according to claim 8, wherein the variable supporting cam assumes the supporting phase during non-image formation and assumes the non-supporting phase during image formation and during extraction of the transfer unit from the apparatus main body.

10. The image forming apparatus according to claim 1, wherein the biasing force receiving portion does not come into contact with the frame during an initial stage of use of the transfer unit.

11. An image forming apparatus comprising:

a plurality of image bearing members;

a transfer unit including:

an intermediate transfer belt;

a plurality of transferring members that sandwich the intermediate transfer belt between the plurality of image bearing members and the plurality of transferring members;

a biasing member that biases each of the plurality of transferring members toward the plurality of image bearing members via the intermediate transfer belt; and a frame that supports the intermediate transfer belt, the plurality of transferring members, and the biasing member; and an apparatus main body that supports the plurality of image bearing members and the transfer unit, and including:

a supporting portion that supports the transfer unit; and a biasing force receiving portion disposed below the plurality of transferring members in a direction orthogonal to a moving direction of a surface of the intermediate transfer belt, and configured to support the transfer unit, wherein the apparatus main body is configured to be movable between a supporting position where the transfer unit is supported and a non-supporting position where the transfer unit is not supported, wherein the apparatus main body further includes a first opening/closing member configured to:

perform a first opening/closing operation of switching between a first open state where an inside of the apparatus main body is exposed and a first closed state where the inside of the apparatus main body is not exposed; and move the biasing force receiving portion between the supporting position and the non-supporting position, wherein the first opening/closing member positions the biasing force receiving portion at:

the supporting position while the first opening/closing member is in the first closed state; and the non-supporting position while the first opening/closing member is in the first open state, wherein the apparatus main body further includes a second opening/closing member disposed at a position that differs from the first opening/closing member and configured to perform a second opening/closing operation of switching between a second open state where the inside of the apparatus main body is exposed and a second closed state where the inside of the apparatus main body is not exposed, and wherein the transfer unit is attachable to and detachable from the apparatus main body while the first opening/closing member is in the first open state and the second opening/closing member is in the second open state.

12. An image forming apparatus comprising:

a plurality of image bearing members;

a transfer unit including:

an intermediate transfer belt;

a plurality of transferring members that sandwich the intermediate transfer belt between the plurality of image bearing members and the plurality of transferring members;

a biasing member that biases each of the plurality of transferring members toward the plurality of image bearing members via the intermediate transfer belt; and a frame that supports the intermediate transfer belt, the plurality of transferring members, and the biasing member; and an apparatus main body that supports the plurality of image bearing members and the transfer unit, and including:

a first supporting portion that supports a side of one end of the transfer unit with respect to the intermediate transfer belt;

a second supporting portion that supports a side of another end of the transfer unit with respect to the intermediate transfer belt; and a biasing force receiving portion configured to support the transfer unit between the first supporting portion and the second supporting portion, wherein the apparatus main body is configured to be movable between a supporting position where the transfer unit is supported and a non-supporting position where the transfer unit is not supported, wherein the apparatus main body further includes a first opening/closing member configured to:

perform a first opening/closing operation of switching between a first open state where an inside of the apparatus main body is exposed and a first closed state where the inside of the apparatus main body is not exposed; and move the biasing force receiving portion between the supporting position and the non-supporting position, wherein the first opening/closing member positions the biasing force receiving portion at:

the supporting position while the first opening/closing member is in the first closed state; and the non-supporting position while the first opening/closing member is in the first open state, wherein the apparatus main body further includes a second opening/closing member disposed at a position that differs from the first opening/closing member and configured to perform a second opening/closing operation of switching between a second open state where the inside of the apparatus main body is exposed and a second closed state where the inside of the apparatus main body is not exposed, and wherein the transfer unit is attachable to and detachable from the apparatus main body while the first opening/closing member is in the first open state and the second opening/closing member is in the second open state.

* * * * *